US007980713B2

(12) United States Patent
Nielsen

(10) Patent No.: US 7,980,713 B2
(45) Date of Patent: Jul. 19, 2011

(54) LIGHTING STRIP SHOWER CLEANER

(76) Inventor: Blake Nielsen, Chicago, IL (US)

( * ) Notice: Subject to any disclaimer, the term of this patent is extended or adjusted under 35 U.S.C. 154(b) by 305 days.

(21) Appl. No.: 12/291,291

(22) Filed: Nov. 7, 2008

(65) Prior Publication Data

US 2010/0118512 A1 May 13, 2010

(51) Int. Cl.
*F21V 33/00* (2006.01)

(52) U.S. Cl. ..... 362/96; 362/643; 362/234; 362/249.11

(58) Field of Classification Search ..... 362/96, 362/643, 253, 234, 249.01, 249.02, 249.11, 362/158, 267, 396–398
See application file for complete search history.

(56) References Cited

U.S. PATENT DOCUMENTS

| | | | | |
|---|---|---|---|---|
| 2,023,848 | A | 12/1935 | Loewenstein | |
| 2,759,546 | A | 8/1956 | Zabriskie | |
| 4,285,470 | A | 8/1981 | Roth | |
| 4,368,505 | A | 1/1983 | Tomforde | |
| 4,924,361 | A | 5/1990 | Von Kohorn | |
| 6,021,960 | A | 2/2000 | Kehat | |
| 6,074,078 | A | 6/2000 | Georgeff et al. | |
| 6,398,381 | B1 * | 6/2002 | Tseng | 362/96 |
| 6,463,600 | B1 | 10/2002 | Conway et al. | |
| 6,742,199 | B2 | 6/2004 | Conway et al. | |
| 6,857,582 | B1 | 2/2005 | Wang | |
| 7,281,811 | B2 * | 10/2007 | Thuot Rann et al. | 362/96 |
| 7,350,720 | B2 * | 4/2008 | Jaworski et al. | 239/55 |
| 7,618,151 | B2 * | 11/2009 | Abbondanzio et al. | 362/96 |
| 2007/0097665 | A1 | 5/2007 | Nanni et al. | |
| 2009/0166378 | A1 * | 7/2009 | Stilley | 222/39 |

* cited by examiner

*Primary Examiner* — Bao Q Truong

(74) *Attorney, Agent, or Firm* — Ice Miller LLP

(57) ABSTRACT

An elongated lighting strip is provided. The lighting strip is positioned inside of a shower or bathtub enclosure in order to both illuminate the enclosure as well as spray or diffuse and aqueous solution onto the enclosure.

23 Claims, 3 Drawing Sheets

LIGHTING STRIP SHOWER CLEANER

FIELD OF THE INVENTION

The present invention relates to elongated lighting strips and, in particular, to elongated lighting strips that spray, or diffuse, an aqueous solution.

For convenience, many people today perform multiple tasks, such as shaving, inside of a shower. However, many showers are dark areas, which provide a problem for those desiring to shave or perform other tasks inside of the shower.

Flexible lighting strips, also referred to as rope lights, are one aesthetically pleasing solution to this problem. Flexible lighting strips are commonly used to illuminate various areas and devices. However, conventional lighting strips perform no other function besides illuminating an area. A lighting strip inside of a shower, for example, should ideally be capable of performing other functions besides just illuminating the inside of the shower. Therefore, there is a need for lighting strips which perform additional functions besides merely illuminating an area.

Cleaning the inside of a bathtub or shower can be time consuming and laborious. As a result, there is a need for devices that either clean or assist in cleaning the inside of such an enclosure. Conventional devices used for this purpose are large and aesthetically unpleasing, adding clutter to showers already littered with various hygienic supplies. Therefore, there is a need for compact devices which not only clean, but perform other tasks, such as illuminate, the inside of a bathtub or shower.

SUMMARY OF THE INVENTION

These needs and other needs are satisfied by the present invention, which comprises a lighting apparatus comprising a lighting assembly for illuminating an area, the lighting assembly comprising a light source, and a liquid dispensing assembly for dispersing an aqueous solution in the area, the liquid dispensing assembly comprising a reservoir for storage of the aqueous solution and a dispenser for dispersing the aqueous solution.

In an alternative embodiment, the lighting apparatus comprises a light source, a reservoir for storage of an aqueous solution and a dispenser for dispersing the aqueous solution from the reservoir.

In yet another alternative embodiment, the lighting apparatus comprises a light source, a reservoir for storage of an aqueous solution and a dispenser comprising a nozzle and a pump, the pump being positioned to receive the aqueous solution from the reservoir and pump the aqueous solution through the nozzle.

BRIEF DESCRIPTION OF THE DRAWINGS

Embodiments of the invention will now be explained in further detail by way of example only with reference to the accompanying figures, in which.

DETAILED DESCRIPTION OF THE INVENTION

Figure 1:
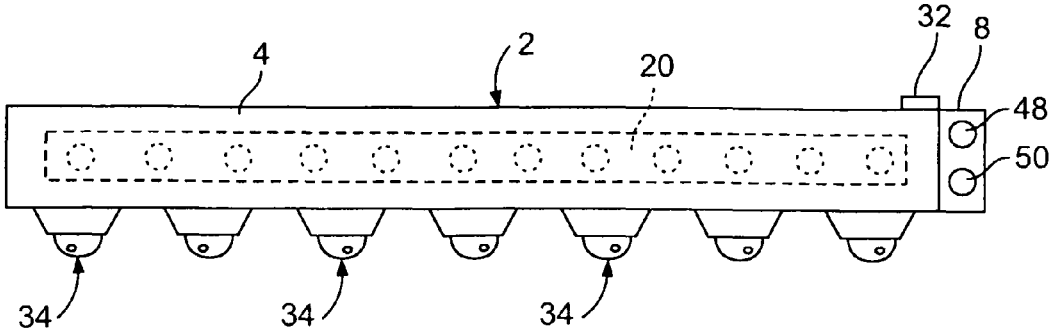
FIG. 1 is a front section view of a lighting strip according to the present invention.
Figure 2:
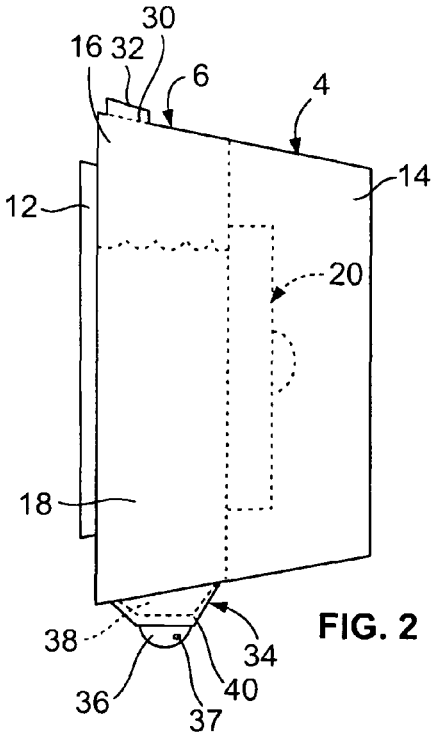
FIG. 2 is a horizontal section view of the lighting strip of FIG. 1.
Figure 3:
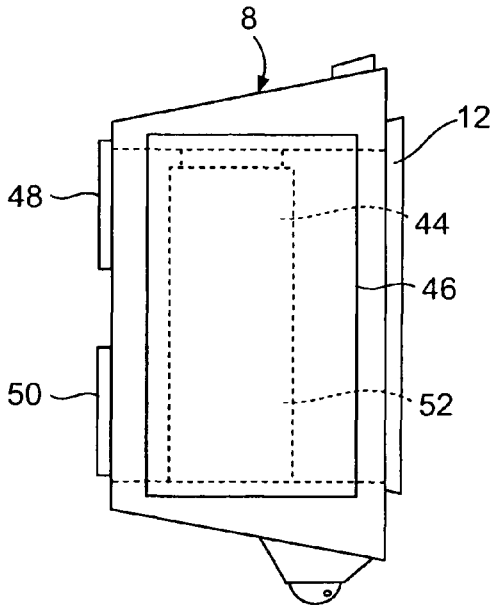
FIG. 3 is a horizontal section view of the lighting strip of FIG. 1.

FIGS. 1-3 illustrate the basic design and construction of a lighting strip 2 according to the present invention. Referring to FIGS. 1-2, lighting strip 2 comprises a lighting assembly 4, a liquid dispensing assembly 6 and a power supply assembly 8. Both the lighting assembly 4 and liquid dispensing assembly 6 perform separate functions, that is, to illuminate and clean, respectively, the area or enclosure in which lighting strip 2 is placed. Power supply assembly 8 supplies the power necessary to perform these functions.

The main purpose of lighting assembly 4 is to house light source 20, which illuminates the area in which lighting strip 2 is placed. Therefore, lighting assembly 4 houses light source 20 inside lighting chamber 14, which is a long narrow cavity, large enough to fit light source 20. Light source 20 can be either removably or permanently installed inside of chamber 14. Preferably, light source 20 is removably installed inside chamber 14, so that it can be removed and replaced in the event that it is defective or ceases to produce light. Light source 20 can be removably installed using any adhesive or other method known in the art.

Figure 4:
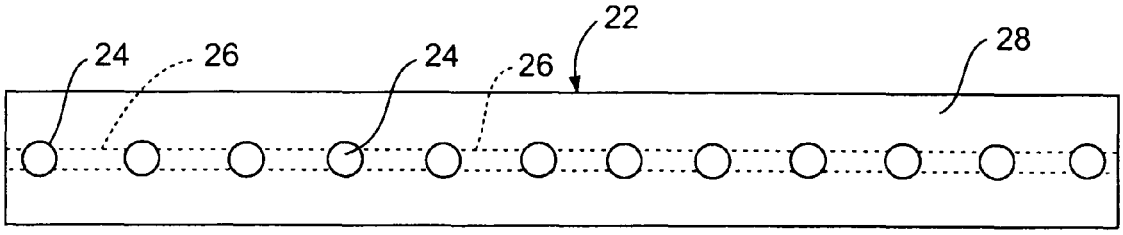
FIG. 4 is detailed view of the light source of the lighting strip of FIG. 1.

Light source 20 can be a variety of lighting systems. LEDs (light emitting diodes) are rectifying semiconductors that convert electrical energy into electromagnetic radiation. They are more energy efficient, more durable and longer lasting than conventional lighting systems. Therefore, light source 20 is preferably formed of LEDs. FIG. 4 shows a preferred embodiment of an LED light strip 22. LED light strip 22 includes a plurality of LEDs 24, which are connected in series by electrical wires 26 fixed in a flexible nonconductive substrate 28. The wires 26 are connected to power source 44 of power supply assembly 8, which transfers the necessary power to illuminate LED light strip 22 or any other light source.

Besides illumination, lighting strip 2 may optionally perform the function of spraying or diffusing an aqueous solution into an area. This function is accomplished by liquid dispensing assembly 6. Liquid dispensing assembly 6 comprises a reservoir 16, which is filled with an aqueous solution 18, such as a cleaning solution. Reservoir 16 is filled with solution 18 through fluid opening 30, which is covered by removable cap 32. Removable cap 32 must be removed from opening 30 in order to fill reservoir 16. After reservoir 16 is filled, cap 32 seals opening 30 so that no other fluid may enter reservoir 16. Since one intended use of lighting strip 2 is in a shower, cap 32 prevents water, for example, from entering reservoir 16 and diluting solution 18.

Liquid dispensing assembly 6 further comprises at least one dispenser 34 for dispersing solution 18. FIGS. 1-2 show an embodiment in which dispenser 34 comprises a nozzle 36, a pump 38 and a pump housing 40. Pump 38 receives solution 18 from reservoir 16 and pumps the solution through at least one aperture 37 in nozzle 36. Nozzle 36 is pivotally connected to pump housing 40 so that aperture 37 can rotate both horizontally and vertically. As a result, solution 18 can be sprayed uniformly over an area as nozzle 36 pivots in relation to pump housing 40.

Like light source 20, dispenser 34 may receive power from power source 44 of power supply assembly 8. Power may not be necessary if dispenser 34 is a simple drip, for example, or any other non-electric method of dispersing an aqueous solution that is known in the art. However, power may be necessary if dispenser 34 requires the use of an electric pump to pump the solution 18 through nozzle 36. If power is necessary, then each element requiring power must be connected to power source 44 of power supply assembly 8 by wires 42 (not shown). Since wires 42 cannot come into contact with aqueous solution 18, wires 42 should run through the housing of liquid dispensing assembly 6 or through a flexible nonconductive substrate that cannot be permeated by any aqueous solution.

Power supply assembly 8 can be located at any convenient position along a lighting strip according to the present invention. In the embodiment shown in FIG. 1, power supply assembly 8 is located at a far end of lighting strip 2. Referring to FIG. 3, power supply assembly 8 comprises a power source 44, a removable latch 46, a light activation button 48 and a spray activation button 50.

Power source 44 can be any suitable power source known in the art that is capable of providing power to light source 20 and dispenser 34, such as a DC battery. In some situations, power source 44 could take advantage of AC line power. However, since a primary use of lighting strip 2 is for showers and bathtubs, the use of any type of external power cord is discouraged. Preferably, power source 44 may be removable or replaceable, or alternatively, be permanent and rechargeable. Referring to FIG. 3, power source 44 is rechargeable battery 52, which may be removed and recharged when low on power. Battery 52 is installed by opening removable latch 46, which provides a watertight seal when closed.

Light activation button 48 and spray activation button 50 control whether power is distributed to light source 20 and dispenser 34, respectively. Light activation button 48 turns light source 20 on and off, just as spray activation button 50 does with dispenser 34. Preferably, spray activation button 50 should be programmed to delay activation of dispenser 34 for a few seconds after being pushed and to run dispenser 34 for only a set period of time. In the place of buttons, one may use any type of power switch which is known in the art to connect and disconnect an electric circuit. Alternatively, one may desire to eliminate the buttons completely and, for example, leave the light source on at all times.

The housing of lighting assembly 4, liquid dispersing assembly 6 and power supply assembly 8 can be made of silicone or any suitable woven or non-woven composite, thermoplastic or thermosetting polymer or other material known in the art that cannot be permeated by water or any aqueous solution. Since the primary purpose of lighting assembly 4 is to house light source 20, the housing of lighting assembly 4 should be made of a translucent material to allow the light from light source 20 to illuminate the area in which it is placed. It is also advantageous for the housing of liquid dispensing assembly 6 to be translucent, as this allows one to easily determine whether reservoir 16 contains an adequate amount of solution 18. However, whether the housing of liquid dispensing assembly 6 must be translucent will depend on the relationship between liquid dispensing assembly 6 and lighting assembly 4. If liquid dispensing assembly 6 does not inhibit the path of light coming from lighting assembly 4, as in FIG. 2, then liquid dispensing assembly 6 need not be translucent. The material used to make the housing of both lighting assembly 4 and liquid dispensing assembly 6 should also preferably be flexible, and thus allow lighting strip 2 to be placed around curves and in various positions inside of a shower or other enclosure.

Lighting strip 2 is fastened to a wall with adhesive 12. Adhesive 12 can be an adhesive tape or any other adhesive capable of securing a lighting strip to a wall. Since lighting strip 2 is intended for use in a shower, the adhesive used must be capable of adhering to a wall when contacted with water.

Figure 5:
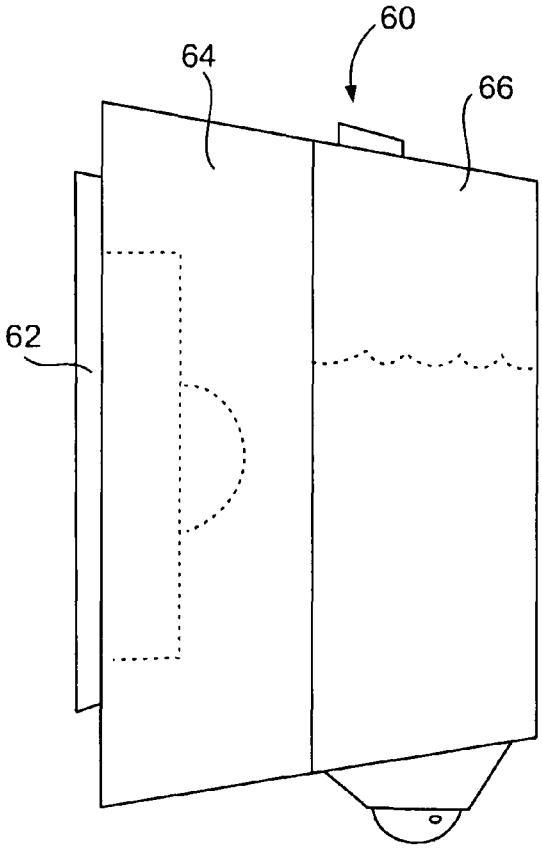
FIG. 5 is a horizontal section view of an alternative embodiment of a lighting strip according to the present invention.
Figure 6:
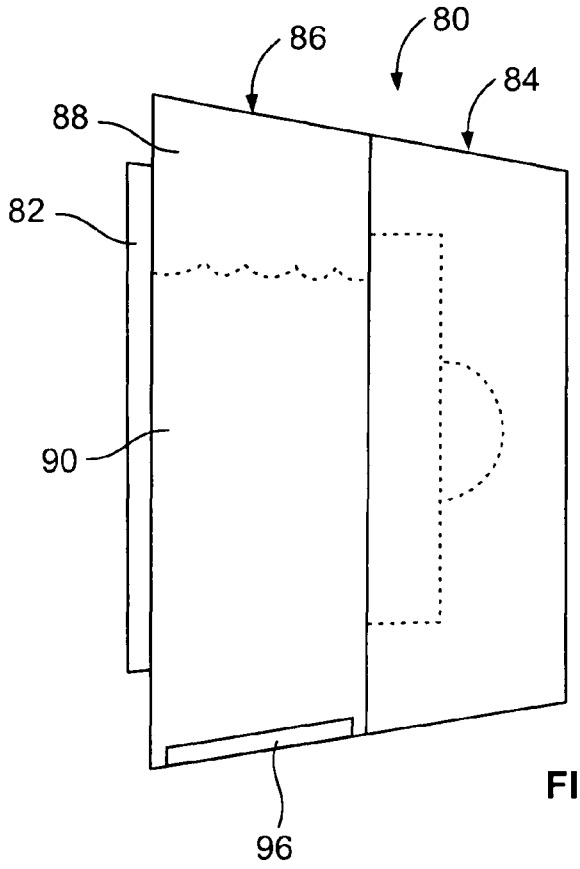
FIG. 6 is a horizontal section view of an alternative embodiment of a lighting strip according to the present invention.
Figure 7:
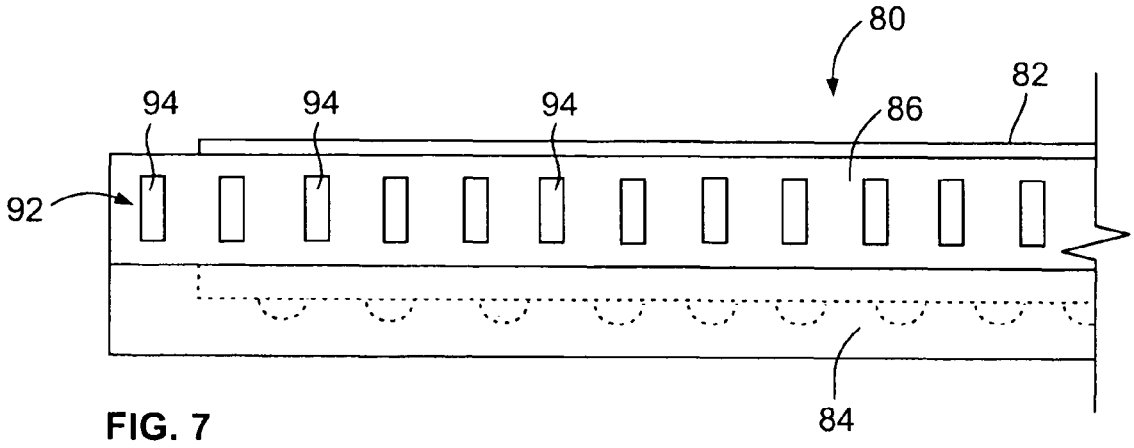
FIG. 7 is a vertical section view of the lighting strip of FIG. 6.

Although lighting strip 2 is one embodiment of the present invention, FIGS. 5-7 show two alternative embodiments. Additionally, one of skill in the art will recognize several other embodiments of the present invention.

Referring to FIG. 5, lighting strip 60 is shown attached to a wall by fastener 62. Like the previous embodiment, lighting strip 60 comprises a lighting assembly 64, a liquid dispensing assembly 66 and a power supply assembly (not shown). However, the positions of lighting assembly 64 and liquid dispensing assembly 66 relative to the wall have been reversed in comparison with lighting strip 2 of FIGS. 1-3. One of ordinary skill in the art will recognize several other configurations for the present invention which alternate the positions of the same basic elements.

Referring to FIG. 6, lighting strip 80 is shown attached to a wall by fastener 82. Like the previous embodiments, lighting strip 80 comprises a lighting assembly 84, a liquid dispensing assembly 86 and a power supply assembly (not shown). Liquid dispensing assembly 86 comprises a reservoir 88, which is filled with an aqueous solution 90. In this embodiment, aqueous solution 90 is an air freshener which diffuses through dispenser 92, which comprises a series of vents 94, shown in FIG. 7. Several air fresheners capable of diffusing from an aqueous solution are known in the art, and any of such could be used with the present invention. In some cases, diffusion of the solution 90 requires heat to be added to the solution. Therefore, dispenser 92 may further comprise at least one heating member 96 to diffuse solution 90. In such a case, heating member 96 should be connected to and activated by the power source in the same way as dispenser 34 in the embodiment of FIGS. 1-3.

Modifications in addition to those described above may be made to the structures and techniques described herein without departing from the spirit and scope of the invention. Accordingly, although specific embodiments have been described, these are examples only and are not limiting on the scope of the invention.

What is claimed is:

1. A lighting apparatus capable of attachment to a shower wall, comprising:

a lighting assembly for illuminating an area, the lighting assembly comprising a light source;

a liquid dispensing assembly for dispersing an aqueous solution in the area, the liquid dispensing assembly comprising a reservoir for storage of the aqueous solution and a dispenser for dispersing the aqueous solution; and a non-electrical attachment means capable of attaching the lighting apparatus to the shower wall.

2. The lighting apparatus of claim 1, wherein the lighting apparatus further comprises a power supply assembly.

3. The lighting apparatus of claim 1, wherein the light source comprises an LED light strip.

4. The lighting apparatus of claim 1, wherein the dispenser comprises a nozzle.

5. The lighting apparatus of claim 1, wherein the dispenser comprises a vent.

6. The lighting apparatus of claim 4, wherein the dispenser further comprises a pump.

7. The lighting apparatus of claim 5, wherein the dispenser further comprises a heating member.

8. A lighting apparatus capable of attachment to a shower wall, comprising:

a light source;

a reservoir for storage of an aqueous solution; and a dispenser for dispersing the aqueous solution from the reservoir; and a non-electrical attachment means capable of attaching the lighting apparatus to the shower wall.

9. The lighting apparatus of claim 8, wherein the lighting apparatus further comprises a power source.

10. The lighting apparatus of claim 8, wherein the light source comprises an LED light strip.

11. The lighting apparatus of claim 8, wherein the dispenser comprises a nozzle.

12. The lighting apparatus of claim 8, wherein the dispenser comprises a vent.

13. The lighting apparatus of claim 11, wherein the dispenser further comprises a pump.

14. The lighting apparatus of claim 12, wherein the dispenser further comprises a heating member.

15. A lighting apparatus capable of attachment to a shower wall, comprising:

a light source;

a reservoir for storage of an aqueous solution; and a dispenser comprising a nozzle and a pump, the pump being positioned to receive the aqueous solution from the reservoir and pump the aqueous solution through the nozzle; and a non-electrical attachment means capable of attaching the lighting apparatus to the shower wall.

16. The lighting apparatus of claim 15, wherein the lighting apparatus further comprises a power source.

17. The lighting apparatus of claim 15, wherein the light source comprises an LED light strip.

18. The lighting apparatus of claim 1, wherein the non-electrical attachment means comprises an adhesive.

19. The lighting apparatus of claim 1, wherein the non-electrical attachment means comprises a fastener.

20. The lighting apparatus of claim 8, wherein the non-electrical attachment means comprises an adhesive.

21. The lighting apparatus of claim 8, wherein the non-electrical attachment means comprises a fastener.

22. The lighting apparatus of claim 15, wherein the non-electrical attachment means comprises an adhesive.

23. The lighting apparatus of claim 15, wherein the non-electrical attachment means comprises a fastener.

* * * * *